US005324195A

United States Patent [19]

Sigler

[11] Patent Number: 5,324,195

[45] Date of Patent: Jun. 28, 1994

[54] JET BURNER CONSTRUCTION, HEATING APPARATUS UTILIZING THE JET BURNER CONSTRUCTION AND METHODS OF MAKING THE SAME

[75] Inventor: Kent K. Sigler, Youngwood, Pa.

[73] Assignee: Robertshaw Controls Company, Richmond, Va.

[21] Appl. No.: 72,232

[22] Filed: Jun. 3, 1993

[51] Int. Cl.[5] ..... F23D 14/58

[52] U.S. Cl. ..... 431/286; 431/353; 431/354; 239/597; 239/600

[58] Field of Search ..... 431/286, 353, 354; 239/597, 598, 600; 126/116 R, 99 A

[56] References Cited

U.S. PATENT DOCUMENTS 5,035,609 7/1991 Riehl ..... 431/286

5,244,382 9/1993 Riehl ..... 431/286

OTHER PUBLICATIONS

Prior known burner construction as set forth in FIGS. 1–9 and 17 of this patent application.

*Primary Examiner*—Carroll B. Dority

*Attorney, Agent, or Firm*—Candor, Candor & Tassone

[57] ABSTRACT

A jet burner construction, heating apparatus utilizing the jet burner construction and methods of making the same are provided, the jet burner construction having opposed ends and having a fluted portion disposed spaced from and intermediate the inlet and the outlet of the burner body and having opposed ends, the fluted portion defining a central opening part and radiating portions of the outlet opening of the burner body which is generally located in the middle of the fluted portion, the fluted portion expanding and extending axially beyond the central opening part at one of the opposed ends thereof and comprising part of a flame retainer unit that also comprises a generally ring-like structure between the one of the opposed ends of the fluted portion and the one of the opposed ends of the burner body, the one of the opposed ends of the fluted portion expanding outwardly substantially at a right angle to the longitudinal axis of the burner construction.

14 Claims, 6 Drawing Sheets

JET BURNER CONSTRUCTION, HEATING APPARATUS UTILIZING THE JET BURNER CONSTRUCTION AND METHODS OF MAKING THE SAME

BACKGROUND OF THE INVENTION

1. Field of the Invention

This invention relates to a new jet burner construction and to a new heating apparatus utilizing such a jet burner construction as well as to new methods of making such a jet burner construction and such a heating apparatus.

2. Prior Art Statement

It is known to provide a jet burner construction comprising a burner body means having a chamber means therein and having an inlet means leading to the chamber means for directing fuel from a fuel source therein and an outlet means leading from the chamber means and defining an outlet opening means through which the fuel is adapted to issue from the chamber means to burn externally to the burner body means, the burner body means having a longitudinal axis extending between the inlet means and the outlet means, the outlet opening means having a central opening part and a plurality of spaced apart opening portions interconnected thereto and radiating outwardly therefrom whereby flows of fuel respectively issuing out of the portions and the central part of said outlet opening means merge together in a turbulent manner externally to the outlet opening means, the burner construction comprising flame retainer means carried by the body means and having outer edge means extending beyond the outlet opening means of the body means to prevent flows of induced air from being created between the flows of fuel issuing from the radiating portions of the outlet opening means, the burner body means being formed of two generally similar body sections secured together in superimposed relation and each having one-half of the outlet opening means and one-half of the flame retainer means thereon, the body means having opposed ends and having a fluted portion disposed spaced from and intermediate the inlet means and the outlet means and having opposed ends, the fluted portion defining the central opening part and the radiating portions of the outlet opening means, the outlet opening means being generally located in the middle of the fluted portion, the fluted portion expanding and extending axially beyond the central opening part at one of the opposed ends thereof and comprising part of the flame retainer means, the flame retainer means also comprising a generally ring-like structure between the one of the opposed ends of the fluted portion and one of the opposed ends of the body means, each one-half of the flame retainer means being integral and one-piece with its respective body section, the one of the opposed ends of the fluted portion expanding outwardly substantially at an angle to the longitudinal axis. For example, see FIGS. 1-9 and 17 of this application for such prior known jet burner construction.

SUMMARY OF THE INVENTION

It is one of the features of this invention to provide a new jet burner construction which has a reduced tendency for the flame issuing therefrom from expanding in a radial direction from the longitudinal axis of the burner construction to too great an extent so that the same will readily enter the inlet end of a heating tube that forms a heating apparatus with such a burner construction.

In particular, it is believed that a greater control of the flame issuing from an outlet opening means of the burner construction and entering the inlet end of a heating tube means will be provided if the expanding end of the fluted portion of the burner construction expands outwardly substantially at a right angle to the longitudinal axis of the burner construction rather than axially with an inclined angle thereof as in the prior known burner construction hereinafter illustrated and described in connection with FIGS. 1-9 and 17.

For example, one embodiment of this invention comprises a jet burner construction comprising a burner body means having a chamber means therein and having an inlet means leading to the chamber means for directing fuel from a fuel source therein and an outlet means leading from the chamber means and defining an outlet opening means through which the fuel is adapted to issue from the chamber means to burn externally to the burner body means, the burner body means having a longitudinal axis extending between the inlet means and the outlet means, the outlet opening means having a central opening part and a plurality of spaced apart opening portions interconnected thereto and radiating outwardly therefrom whereby flows of fuel respectively issuing out of the portions and the central part of the outlet opening merge together in a turbulent manner externally of the outlet opening means, the burner construction comprising flame retainer means carried by the body means and having outer edge means extending beyond the outlet opening means of the body means to prevent flows of induced air from being created between the flows of fuel issuing from the radiating portions of the outlet opening means, the burner body means being formed of two generally similar body sections secured together in superimposed relation and each having generally one-half of the outlet opening means and one-half of the flame retainer means thereon, the body means having opposed ends and having a fluted portion disposed spaced from and intermediate the inlet means and the outlet means and having opposed ends, the fluted portion defining the central opening part and the radiating portions of the outlet opening means, the outlet opening means being generally located in the middle of the fluted portion, the fluted portion expanding and extending axially beyond the central opening part at one of the opposed ends thereof and comprising part of the flame retainer means, the flame retainer means also comprising a generally ring-like structure between the one of the opposed ends of the fluted portion and the one of the opposed ends of the body means, each one-half of the flame retainer means being integral and one-piece with its respective body section, the one of the opposed ends of the fluted portion expanding outwardly substantially at a right angle to the longitudinal axis.

Accordingly, it is an object of this invention to provide a new jet burner construction having one or more of the novel features of this invention as set forth above or hereinafter shown or described.

Another object of this invention is to provide a new method of making such a jet burner construction, the method of this invention having one or more of the novel features of this invention as set forth above or hereinafter shown or described.

Another object of this invention is to provide a new heating apparatus utilizing such a jet burner construction, the heating apparatus of this invention having one or more of the novel features of this invention as set forth above or hereinafter shown or described.

Another object of this invention is to provide a new method of making such a heating apparatus, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
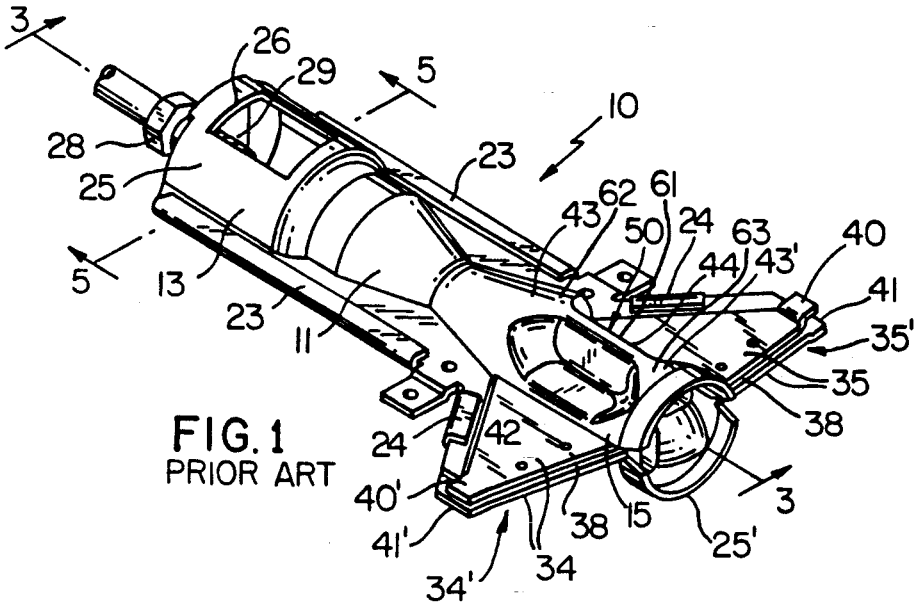
FIG. 1 PRIOR ART
FIG. 1 is a perspective view of the prior known jet burner construction.

While the various features of this invention are hereinafter illustrated and described as being particularly adapted to provide a burner construction for a jet burner construction application thereof, it is to be understood that the various features of this invention can be utilized singly or in various combinations thereof to provide a burner construction for other apparatus as desired.

Therefore, this invention is not to be limited to only the embodiment illustrated in the drawings, because the drawings are merely utilized to illustrate one of the wide variety of uses of this invention.

It is believed that in order to fully understand the features of this invention a complete description should be first made of the prior known burner construction illustrated in FIGS. 1-9 and 17, such prior known burner construction being disclosed and claimed in a copending patent application Ser. No. 805,546 filed Dec. 10, 1991 of Fred Riehl.

Figure 2:
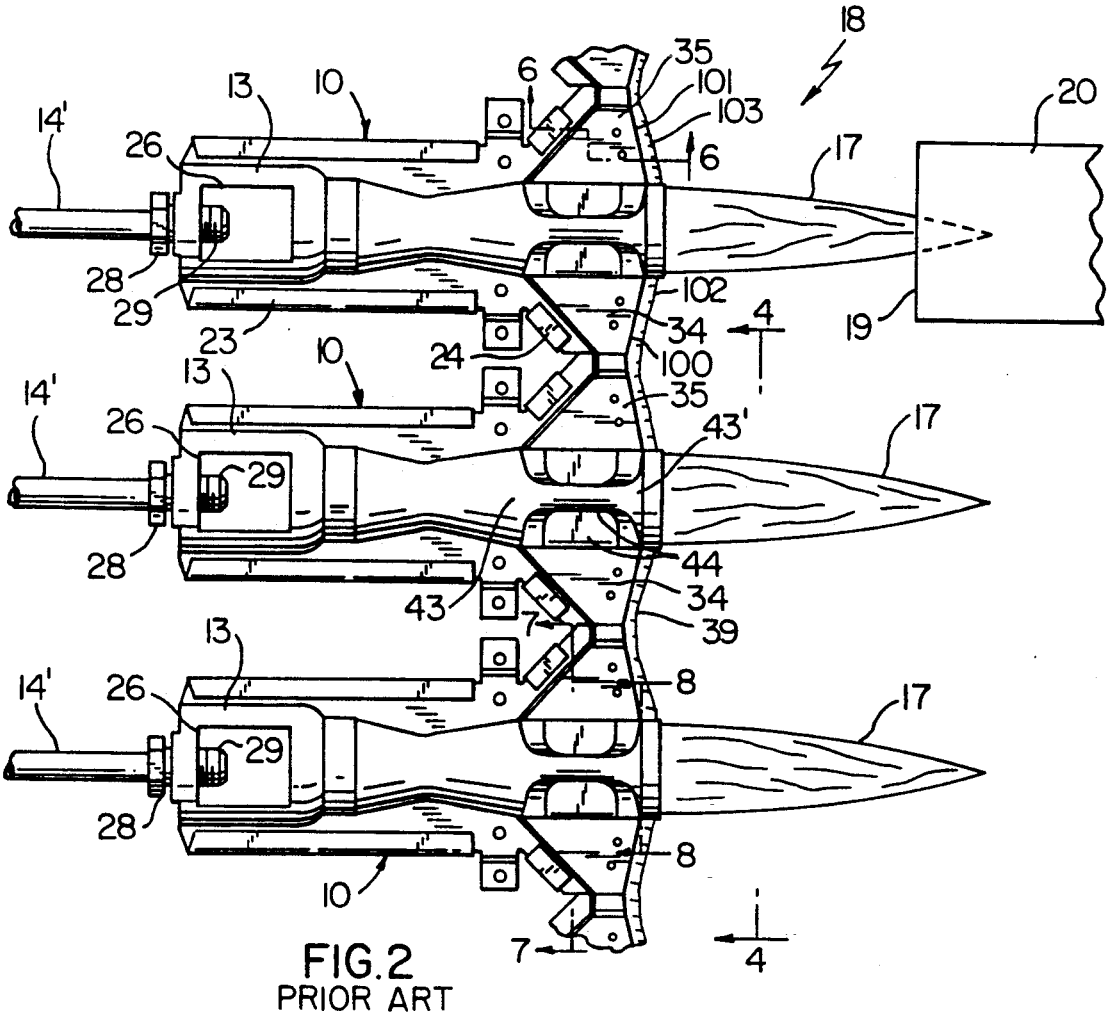
FIG. 2 PRIOR ART
FIG. 2 is a fragmentary top view of a plurality of the jet burner constructions of FIG. 1 arranged in the heating apparatus.
Figure 3:
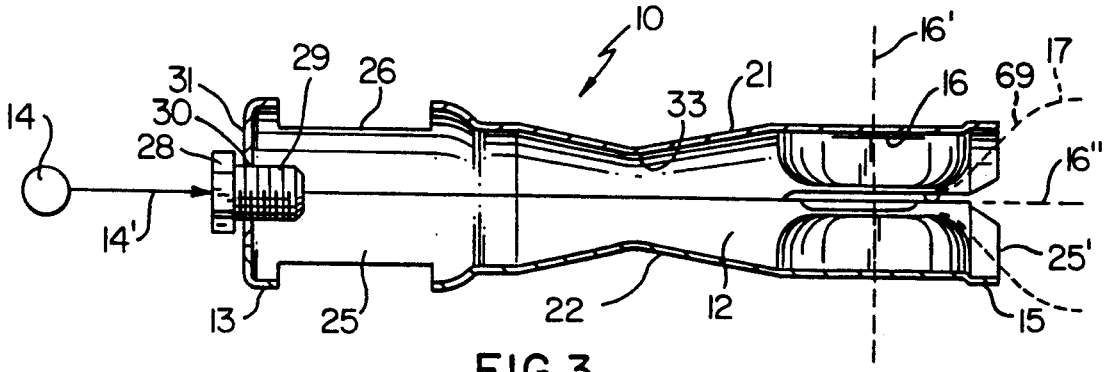
FIG. 3 PRIOR ART
FIG. 3 is a cross-sectional view taken on line 3—3 of FIG. 1.
Figure 7:
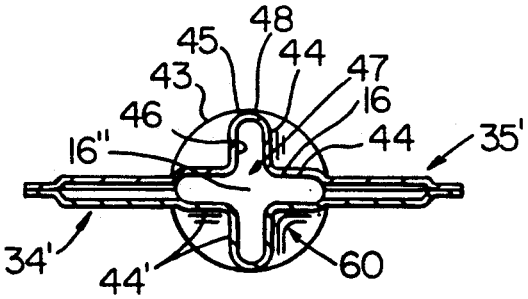
FIG. 7 PRIOR ART
FIG. 7 is a cross-sectional view taken on line 7—7 of FIG. 2.
Figure 8:
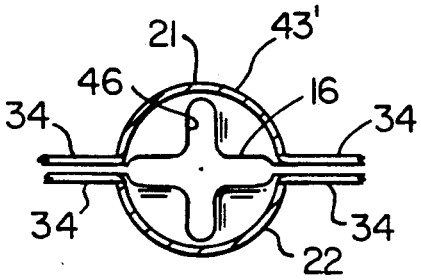
FIG. 8 PRIOR ART
FIG. 8 is a cross-sectional view taken on line 8—8 of FIG. 2.
Figure 10:
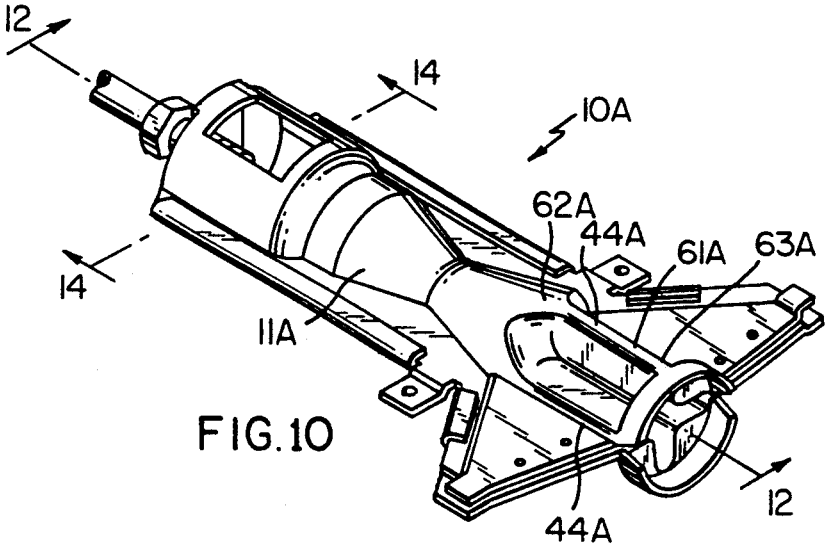
FIG. 10 is a view similar to FIG. 1 and illustrates the new jet burner construction of this invention.
Figure 11:
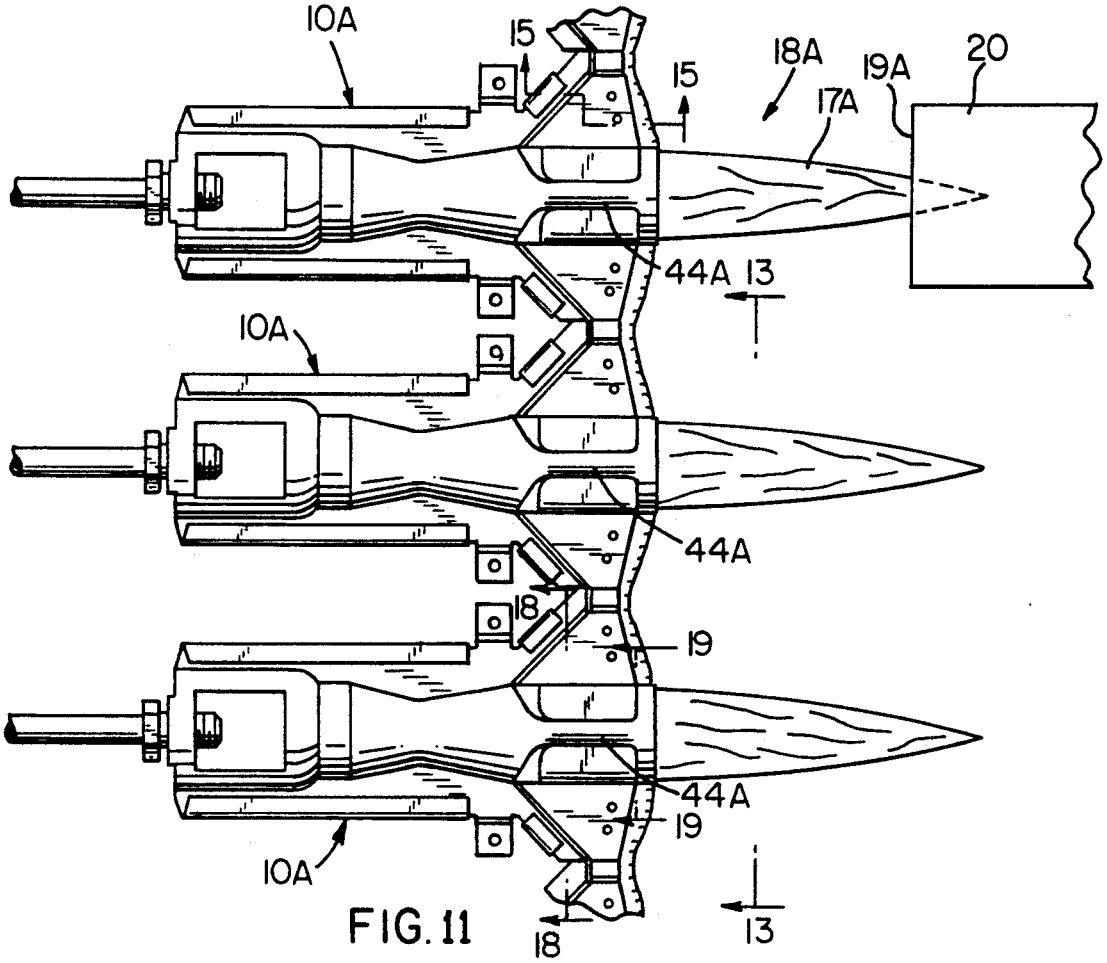
FIG. 11 is a fragmentary top view of a plurality of the jet burner constructions of FIG. 10 arranged in the heating apparatus of this invention.

Referring now to FIGS. 1, 2 and 3, the prior known jet burner construction is generally indicated by the reference numeral 10 and comprises a burner body means 11 having a chamber means 12 therein and having an inlet means 13 leading to the chamber means 12 for directing fuel, such as natural or synthetic gas, from a fuel source 14 therein and an outlet means 15 leading from the chamber means 12 and defining an outlet opening means 16, FIG. 7, through which the fuel is adapted to issue from the chamber means 12 to burn externally to the burner body means 11 as illustrated by the flames 17 in FIG. 2.

Figure 4:
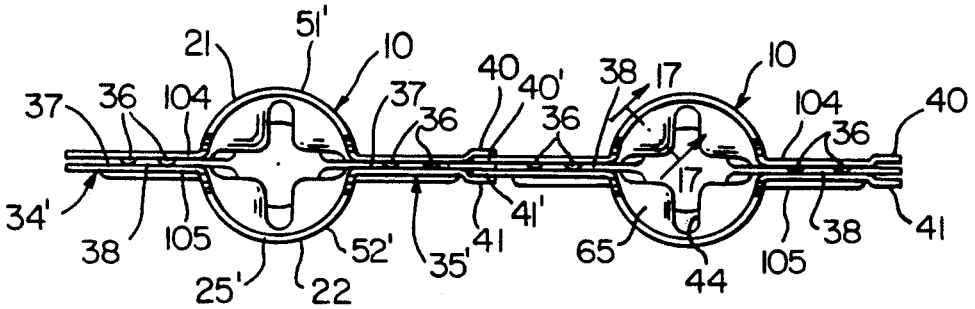
FIG. 4 PRIOR ART
FIG. 4 is an enlarged fragmentary end view taken in the direction of the arrows 4—4 of FIG. 2 and illustrates the outlet ends of two of the jet burner constructions without having the fuel burning at the outlet ends thereof as illustrated in FIG. 2.
Figure 5:
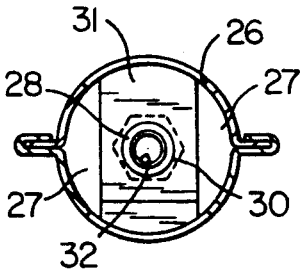
FIG. 5 PRIOR ART
FIG. 5 is a cross-sectional view taken on line 5—5 of FIG. 1.

The jet burner construction 10 is adapted to be arranged in side-by-side aligned relation with a plurality of other jet burner constructions 10 in the manner illustrated in FIGS. 2 and 4 to be utilized in a heating apparatus that is generally indicated by the reference numeral 18 in FIG. 2 wherein each jet burner construction 10 is adapted to direct its flame 17 into an inlet end 19 of a heat tube arrangement 20 which extracts heat from that flame 17 in an efficient manner that is well known in the art. For example, see the Bryant Formula 1000 heating apparatus of the Carrier Corporation of Syracuse, New York and the U.S. Pat. No. 5,035,609, to Riehl, which U.S. patent is being incorporated into this disclosure by this reference thereto.

Therefore, further details of the structure and of the operation of the heating apparatus 18 need not be set forth.

Figure 9:
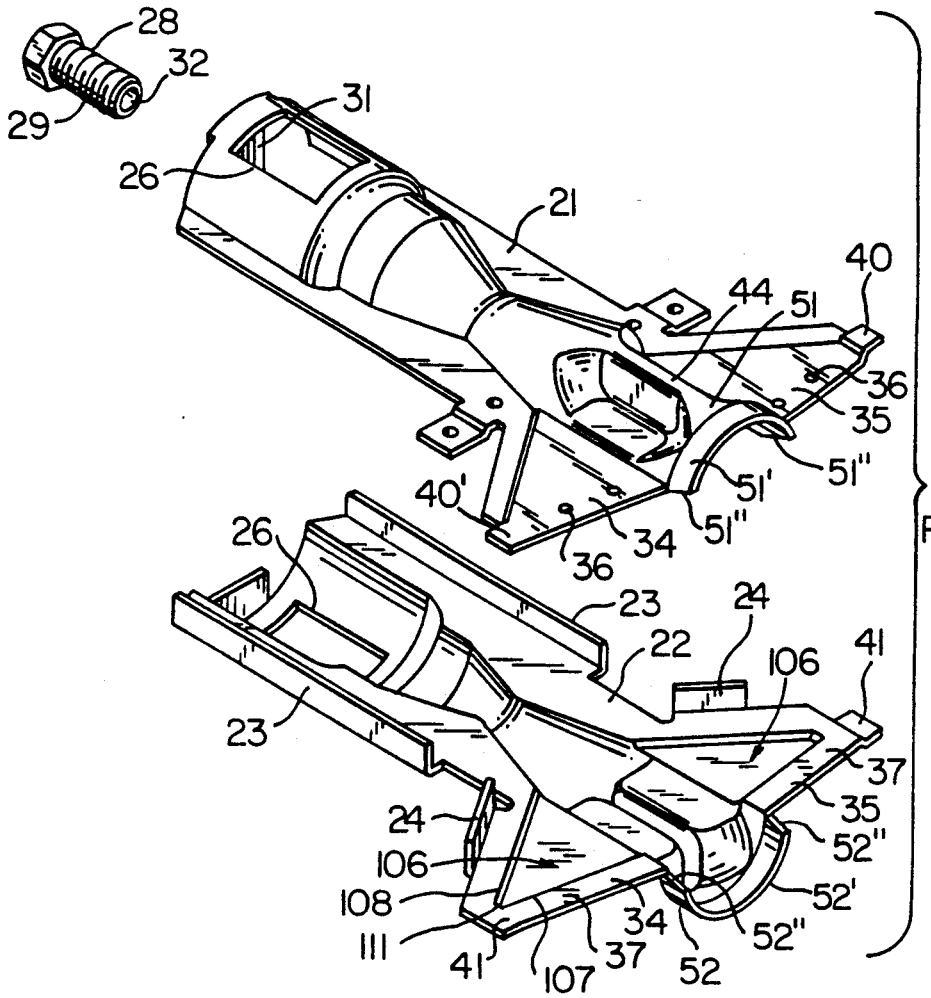
FIG. 9 PRIOR ART
FIG. 9 is an exploded perspective view of the various parts for forming the jet burner construction of FIG. 1.

The jet burner construction 10 has the body means 11 thereof formed from two substantially similar sheet metal plates 21 and 22, FIG. 9, suitably stamped and shaped in the configurations illustrated in the drawings so that when the plates 21 and 22 are disposed together in face-to-face relation, flange means 23 and 24 of the plate means 22 are folded over against the plate means 21 in the manner illustrated in FIG. 1 to seal the plates 21 and 22 together whereby the two plate means 21 and 22 readily form the body means 11 of the burner construction 10 in substantially the same manner as the burner construction set forth in the aforementioned U.S. Pat. No. 5,035,609 to Riehl.

In one working embodiment of the jet burner construction 10, the plate means 21 and 22 are each formed from an aluminized steel strip RMS-421 that is approximately 0.035 of an inch thick, the resulting burner body means 11 being approximately 5.187 inches in length.

The inlet means 13 of the burner body means 11 defines a substantially cylindrical wall means 25 that has a plurality of primary air intake openings 26 formed therethrough downstream from a substantially circular end opening 27 in which an orifice member 28 is disposed, the orifice member 28 having a threaded portion 29 threadedly disposed in an opening 30 formed through integral tab means 31 of the plate 21 which is bent at a right angle thereto. In this manner, fuel from the fuel source 14 is adapted to be directed to the orifice member 28 by a conduit 14', FIG. 2, to issue out of an orifice 32 thereof into the chamber means 12 to mix with the primary air being drawn into the chamber means 12 through the primary air slots 26 in a manner well known in the art so that the air fuel mixture will pass through a venturi portion 33, FIG. 3, of the chamber means 12 before the same reaches the outlet means 15 of the chamber means 12 to issue out of the outlet opening 16 in a unique manner that will be hereinafter set forth.

The plates 21 and 22 that form the burner body means 11 each has a pair of wing-like extensions 34 and 35 extending outwardly therefrom in a coplanar manner so that when the formed plates 21 and 22 are secured together by the folded over flange means 23 and 24 to form the burner body means 11, the cooperating extensions 34 and 35 define wing-like extensions that are generally indicated by the reference numeral 34' and 35', and that extend from opposed sides of the burner body means 11 adjacent the outlet end means 15 thereof.

The wing-like extensions 34 and 35 of the plate 21 are respectively stepped upwardly as illustrated and have a plurality of dimples 36 formed therein to respectively engage against the surfaces 37 of the wing-like extensions 34 and 35 of the other plate 22 so as to space the facing surfaces 37 of the cooperating pairs of wing-like structures 34 and 35 from each other to define a fuel issuing slot means 38 therebetween that respectively interconnects to the chamber means 12 and the outlet opening 16 so that fuel can issue from the slot means 38 of the wing-like extensions 34' and 35' to define front end carry-over ignition flame means 39 as illustrated in FIG. 2 for multiple burner ignition propagation purposes in the apparatus 18 in a manner well known in the art so that only ignition structure need be provided for one of the jet burner constructions 10 in the apparatus 18 and the other burner constructions 10 will be ignited therefrom in a series manner as is well known in the art.

However, in order to prevent delayed ignition due to poor alignment of the burner constructions 10, the wing-like extension 34 of the plate 21 and the wing-like extension 35 of the plate 22 of each burner body means 11 is provided with tabs 40 and 41 which are disposed or stepped out of the plane of the respective wing-like extensions 35 so as to provide the overlapping linked arrangement with the nonstepped tabs 40' and 41' illustrated in FIGS. 2 and 4 of the adjacent burner constructions 10 when the jet burner constructions 10 are arranged in aligned relation as illustrated. Similar tab alignment means are set forth in the U.S. Pat. No. 4,179,261, to Riehl, whereby this patent is being incorporated into this disclosure by this reference thereto.

Figure 6:
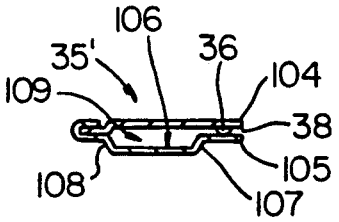
FIG. 6 PRIOR ART
FIG. 6 is a cross-sectional view taken on line 6—6 of FIG. 2.

The slots 38 in the wing-like extensions 34' and 35' extend respectively along the entire respective leading edge means 100 and 101 thereof as illustrated in FIG. 2 and through which the carry-over flames 102 and 103 can issue as the same are being fed fuel from the chamber means 12 at a point downstream from the venturi section 33 and then out between the spaced edge means 104 and 105 of the respective wing-like sections 34' and 35' as illustrated in FIGS. 4 and 6.

It was found according to the teachings of the invention set forth in the U.S. Pat. No. 5,131,839 to Riehl, whereby this U.S. patent is being incorporated into this disclosure by this reference thereto, that even though the extensions 34 and 35 of the upper plate 21 have the leading edges 100 and 101 thereof spaced above the leading edges 100 and 101 of the wing-like extensions 34 and 35 of the lower plate 22 by the dimples 36 so as to define the height of the outlet slot 38 to be approximately 0.042 of an inch throughout the lengths of the edges 100 and 101, the triangular portions 106 of the extensions 34 and 35 of the plate 22 that are bounded by the converging lines 107 and 108 from the respective edge means 104 should be uniformly stepped downwardly beyond the surface 37 of the extensions 34 and 35 of the plate 22 so as to provide sufficient fuel to issue out of the outlet slots 38 even at one-third turn down rate of pressure on natural gas or propane gas.

In particular, the triangular sections 106 are stepped downwardly so as to provide a height thereof below the cooperating surfaces 37 on the extensions 34 and 35 of the plate 21 to be approximately 0.093 of an inch throughout the entire surface area of the sections 106 as illustrated in FIGS. 6 and 7.

In the one working embodiment of the burner construction 10, wherein each slot 38 has the height of 0.042 of an inch, the resulting chamber 109 between the respective triangular section 106 and the surface 37 of the upper plate 21 has a height of approximately 0.093 of an inch, the length from a juncture point 111 of the lines 107 and 108 to the center line or central longitudinal axis of the body means 11 of the respective burner construction 10 is approximately 1.265 inches long. Such chambers 109 insure sufficient fuel flow to issue from the outlet slots 38 of the wing-like extensions 34' and 35' for flame propagation at a one-third turn down rate (0.4 of an inch) pressure on natural gas and (1.1 inches) pressure using propane fuel. This increased fuel entrainment for carry-over purposes intercepts the main fuel flow chamber means 12 and permits fuel flow through the 0.093 of an inch sections or chambers 109 to be expelled through the 0.042 of an inch carry-over flame port slots 38 whereby the geometry of the fuel flow pressure enhancement results in successful flame propagation with carry-over widths of 3 inches and 3½ inches on one-third rate operation of the burner construction 10.

Thus, it can be seen that the stepped sections 106 of the plate 22 for the burner constructions 10 uniquely supply fuel to the outlet slots 38 for flame propagation purposes during the use of the burner construction 10 as previously set forth and hereinafter described.

The outlet end means 15 of the burner body means 11 has its wall means 42 defining substantially cylindrical portions 43 and 43' at each end thereof and a plurality of fluted portions 44 intermediate the portions 43 and 43' thereof, each flute 44 comprising a substantially U-shaped portion 45 that has an outlet opening portion 46 defined thereby and radiating outwardly from a central part 47 of the outlet means 16 and being interconnected thereto. The radiating portions 46 in the one working embodiment of the burner body 11 being four in number and being disposed substantially 90° apart from the adjacent portions 46 and having outer closed ends 48 thereof defining a circular configuration that is substantially concentric to the central part 47 of the opening means 16 that also defines a substantially circular configuration, the opening means 16 being defined by a plane 16' passing through the middle of the flutes 44 and being perpendicular to a longitudinal axis 16'' of the respective burner construction 10 as illustrated in FIGS. 3 and 7.

The two portions 46 on opposite sides of the outlet opening 15 interconnect with the slot means 38 of the wing-like extensions 34' and 35' of the resulting jet burner constructions 10 so as to supply fuel thereto from the chamber means 12.

In this manner, it was found that the flows of fuel issuing out of the outlet opening means 16 at the portions 46 and central part 47 thereof merge together in a turbulent manner externally to the outlet opening means 16 to provide for improved fuel combustion while maintaining the port velocity of the fuel being injected therefrom without requiring internal turbulent enhancers as in the prior known jet burner constructions. It was also found that the resulting flame means 17 of the burner construction 10 has a distinct outer and inner mantle of the flame characteristics which results from the improved fuel combustion.

In the one working embodiment of the jet burner construction 10, each radiating portion 46 and the outlet opening means 16 has the outer part 48 thereof defining a circle that is approximately 1.000 inch in diameter with the spacing between the legs of the portion 46 being approximately 0.186 of an inch, the throat of the venturi portion 33 being spaced from the inlet end opening 27 approximately 2.662 inches and the cylindrical wall means 25 at the inlet end means 13 being approximately 1.250 of an inch in diameter. The flutes 44 begin at approximately 3.682 of an inch from the inlet opening 27, terminate approximately 0.187 of an inch from the end edge means 25', are approximately 1.318 inches long and each has the closed end 48 thereof defined by a radius that is approximately 0.093 of an inch.

The jet burner construction 10 further comprises flame retainer means that is generally indicated by the reference numeral 50 and as illustrated in FIG. 9 comprises two parts 51 and 52 each being integral and one-piece with its respective plate means 21 or 22.

In particular, the parts 51 and 52 of the flame retainer means 50 respectively comprise the part of the plate means 21 and 22 that extend from the resulting outlet opening means 16 to the end edge means 25', the parts 51 and 52 respectively defining semi-circular end sections 51' and 52' that are stepped outwardly from and extend beyond the cylindrical end 43' of the outlet means 25 as well as beyond the wing-like extensions 34' and 35' in the manner illustrated in FIG. 1. End edge means 51'' and 52'' of the sections 51' and 52' of the members 51 and 52 are beveled as illustrated.

It is believed that with such a flame retention means 50, the flame retention means 50 prevent flows of induced air from being created along the areas 60 of the fluted arrangement 61 and thereby would tend to prevent flame blow off that would cause unburned fuel to enter into the heat exchanger tubes 20 of the heating apparatus 18 whereby the combustion results of the fuel issuing from the outlet opening 16 would be greatly enhanced by the flame retention or retainer means 50 in substantially the same manner as the flame retainer means of the aforementioned U.S. Pat. No. 5,035,609 to Riehl.

Therefore, it can be seen that it is a relatively simple method to form the jet burner construction 10 from two suitably stamped and formed plate means 21 and 22 and that is adapted to operate in a manner now to be described.

As previously stated, once the jet burner construction 10 has been properly mounted in a suitable apparatus, such as the heating apparatus 18 illustrated in FIG. 2, fuel is adapted to be directed into the chamber means 12 of that burner construction 10 through suitable conduit means 14' leading from the fuel source 14 so that the same will draw primary air through the openings 26 into the chamber means 12 and pass through the venturi means 33 to issue out of the outlet end means 15 after passing through the outlet opening means 16 thereof into the four flow paths provided by the radiating portions 46 of the opening means 16 to combine with the fuel issuing out of the central part 47 of the opening means 16 in a turbulent manner that can be ignited by any suitable ignition means so that the resulting flame means 17 will be directed into the inlet 19 of the heat exchanger tube 20 to have heat extracted therefrom in a manner well known in the art, the lit burner construction 10 creating the propagating side flame means 102 and 103 along the wing-like portions 34' and 35' thereof for igniting the issuing fuel from adjacent burner constructions 10 in the manner previously set forth.

As previously stated, the enlarged chambers 109 in the wing-like extensions 34' and 35' insure sufficient fuel to flow to the outlet slots 38 to produce the carry-over flames 102 and 103 even on a reduced rate of fuel flow into the main chamber means 12.

Also as previously stated, the flame retention or retainer means 50 prevents secondary air from being created that might blow the flame 17 off of the outlet opening means 16 as the retention means 50 prevents air from being induced along the outside of the spaces 60 between the flutes 44 for the reasons previously set forth.

However, as previously stated, it is one of the features of this invention to tend to improve the flow pattern of the flame means 17 issuing from the burner constructions 10 previously described and the burner construction of this invention for accomplishing this feature is generally indicated by the reference numeral 10A in FIGS. 11–16 and 18–20 and parts thereof that are similar to the parts of the burner construction 10 previously described are indicated by like reference numerals followed by the reference letter "A".

As illustrated in FIGS. 11–16 and 18–20, it can be seen that the burner construction 10A of this invention is substantially identical to the burner construction 10 previously described except that the flutes 44A define the fluted arrangement 61A with its opposed ends 62A and 63A being uniquely different.

Figure 12:
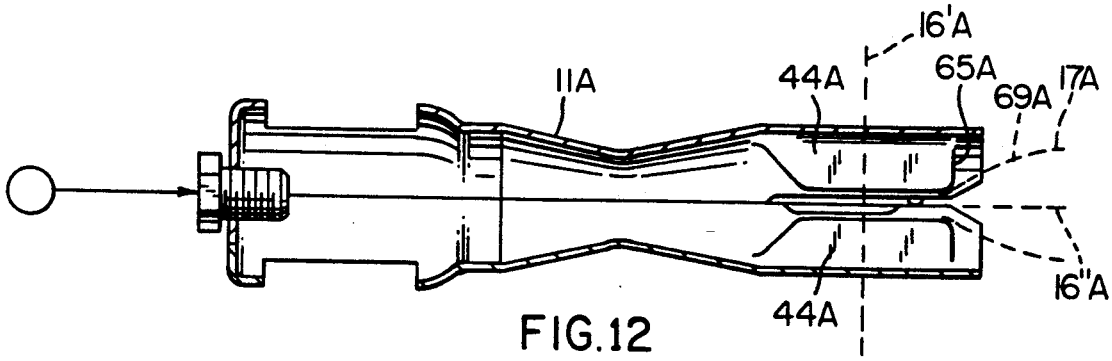
FIG. 12 is an enlarged cross-sectional view taken on line 12—12 of FIG. 10.

In particular, the end 62A of the fluted arrangement 61A of the burner construction 10A is substantially identical to the like end 62 of the fluted arrangement 61 of the burner construction 10 previously described whereas the end 63A of the fluted portion 61A of the burner construction 10A of this invention abruptly expands outwardly at a right angle to the longitudinal axis 16''A, FIG. 12, of the burner body means 11A rather than inclining at an angle axially along the longitudinal axis 16'' as in the burner construction 10 previously described.

Figure 13:
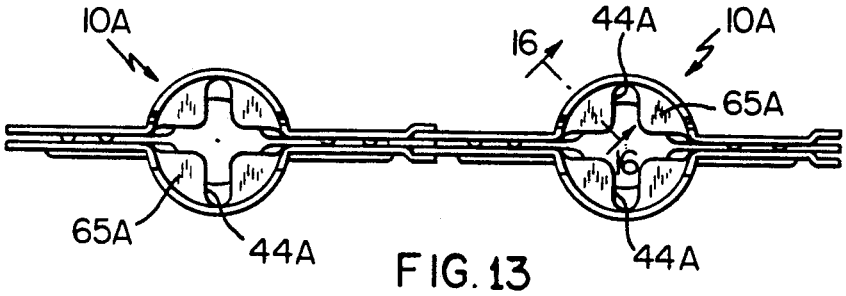
FIG. 13 is an enlarged fragmentary end view taken in the direction of the arrows 13—13 of FIG. 11 and illustrates the outlet ends of two of the jet burner constructions of this invention without having the fuel burning at the outlet ends thereof as illustrated in FIG. 11.
Figure 15:
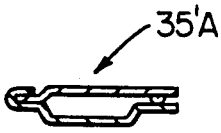
FIG. 15 is an enlarged cross-sectional view taken on line 15—15 of FIG. 11.
Figure 14:
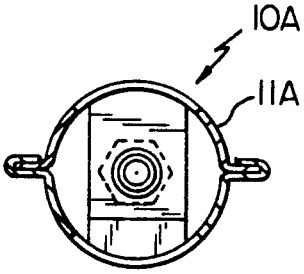
FIG. 14 is an enlarged cross-sectional view taken on line 14—14 of FIG. 10.
Figure 16:
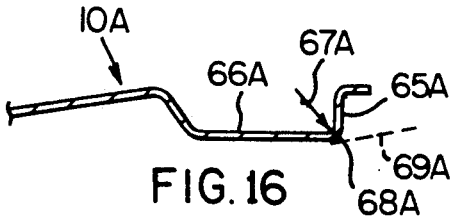
FIG. 16 is a fragmentary cross-sectional view taken on lines 16—16 of FIG. 13.

For example, it can be seen in FIG. 13 that each burner construction 10A has four like parts 65A at the end 63A of the fluted portion 61A that are respectively separated by the flutes 44A, each part 65A being substantially disposed at an abrupt right angle relative to the remainder 66A of the fluted arrangement or portion 61A as fully illustrated in FIGS. 12 and 16. In contrast, it can be seen in FIG. 17 that the prior known burner construction 10 has each part 65 disposed at an inclined angle relative to the remaining part 66 with the same making a relatively large radius 67 with the remainder 66 whereas each part 65A of the burner construction 10A of this invention make a relatively small radius 67A with the remainder 66A.

In particular, in one working embodiment of the burner construction 10A of this invention, the radius 67A for each part 65A is approximately 0.025 of an inch whereas the radius 67 of each part 65 of the prior know burner construction 10 is approximately 0.100 of an inch.

Figure 17:
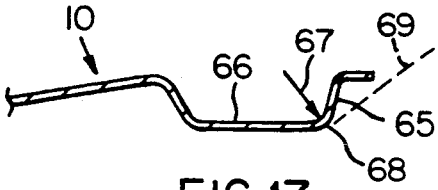
FIG.17 PRIOR ART
FIG. 17 is a view similar to FIG. 16 and is taken on line 17—17 of FIG. 4.
Figure 20:
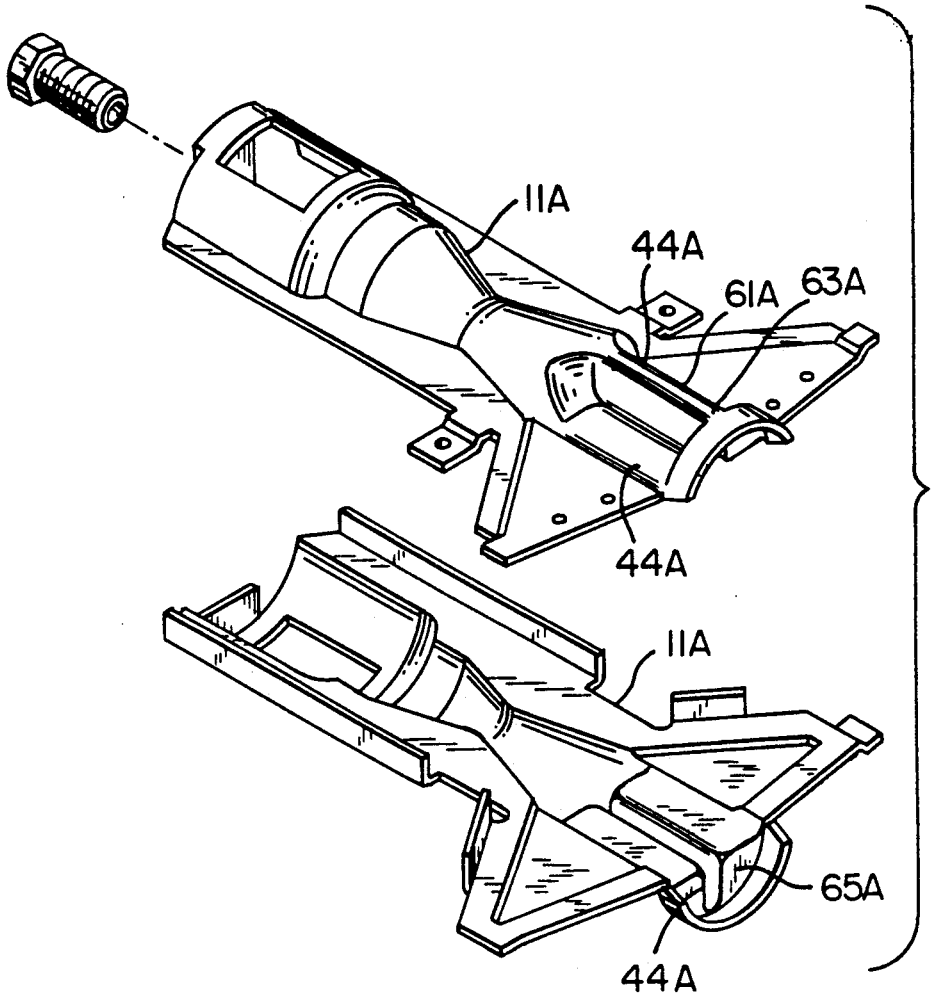
FIG. 20 is an exploded perspective view of the various parts for forming the jet burner construction of FIG. 10.
Figure 18:
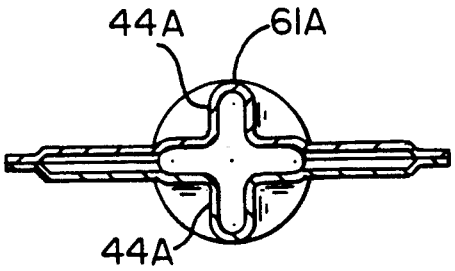
FIG. 18 is an enlarged cross-sectional view taken on line 18—18 of FIG. 11.
Figure 19:
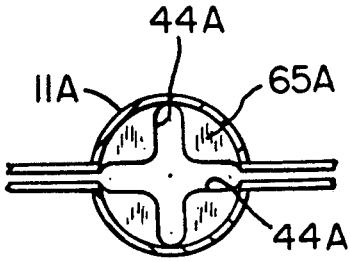
FIG. 19 is an enlarged cross-sectional view taken on line 19—19 of FIG. 11.

It has been found that when the gas flow through the opening means 16 or 16A reaches the end 63 or 63A of the fluted portion 61 or 61A of the burner construction 10 or 10A, the flow of fuel tends to follow the contour of the inner edges 68 or 68A of the parts 65 and 65A as represented by the dashed lines 69 and 69A in FIG. 3 or FIG. 12. Thus, it can be seen in FIG. 16 that the gas flow line 69A is less influenced by the sharp or abrupt curved edge 68A than by the more gradual curved edge 68 of the prior art burner construction 10 as illustrated in FIG. 17 wherein the gas flow line 69 tends to follow the curve of the edge 68 more than in the burner construction 10A of this invention. Also, it can be seen in FIG. 3 that the dashed lines 69 tend to define the flame 17 as spreading more radially outwardly from the axis 16' in contrast to the less expanding dashed lines 69A that define the flame 17A issuing from the burner construction 10A of this invention as illustrated in FIG. 12.

Therefore, since the burner construction 10A of this invention functions in the same general manner as the burner construction 10 previously described, it is believed that a further description of the operation of the burner construction 10A is not necessary except to state that it is believed that the burner constructions 10A perform in a manner to assure that the flames 17A thereof respectively enter the inlet ends 18A of the heater tubes 20 of the apparatus 18A without extending beyond the openings 19A thereof as might be the case with the burner constructions 10 if the flames 17 thereof spread radially outwardly to too large an extent by the more gradual angled edges 68 at the end 63 of the fluted arrangement or portion 61 thereof.

Accordingly, it can be seen that this invention not only provides a new jet burner construction and a new method of making the same, but also this invention provides a new heating apparatus utilizing such a jet burner construction and a new method of making the same.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a jet burner construction comprising a burner body means having a chamber means therein and having an inlet means leading to said chamber means for directing fuel from a fuel source therein and an outlet means leading from said chamber means and defining an outlet opening means through which said fuel is adapted to issue from said chamber means to burn externally to said burner body means, said burner body means having a longitudinal axis extending between said inlet means and said outlet means, said outlet opening means having a central opening part and a plurality of spaced apart opening portions interconnected thereto and radiating outwardly therefrom whereby flows of fuel respectively issuing out of said portions and said central part of said outlet opening means merge together in a turbulent manner externally of said outlet opening means, said burner construction comprising flame retainer means carried by said body means and having outer edge means extending beyond said outlet opening means of said body means to prevent flows of induced air from being created between the flows of fuel issuing from said radiating portions of said outlet opening means, said burner body means being formed of two generally similar body sections secured together in superimposed relation and each having generally one-half of said outlet opening means and one-half of said flame retainer means thereon, said body means having opposed ends and having a fluted portion disposed spaced from and intermediate said opposed ends of said body means and having opposed ends, said fluted portion defining said central opening part and said radiating portions of said outlet opening means, said outlet opening means being generally located in the middle of said fluted portion, said fluted portion expanding and extending axially beyond said central opening part at one of said opposed ends thereof and comprising part of said flame retainer means, said flame retainer means also comprising a generally ring-like structure between said one of said opposed ends of said fluted portion and one of said opposed ends of said body means, each one-half of said flame retainer means being integral and one-piece with its respective body section, the improvement wherein said one of said opposed ends of said fluted portion expands outwardly at a substantially sharp right angle to said longitudinal axis and with a radius of approximately 0.025 of an inch.

2. A jet burner construction as set forth in claim 1 wherein said one of said opposed ends of said fluted portion has a plurality of parts respectively separated by said radiating portions of said outlet opening means that expand substantially at said right angle from said central opening part of said outlet opening means to said ring-like structure.

3. A jet burner construction as set forth in claim 1 wherein said burner body means has wing-like extensions respectively disposed on opposite sides thereof for respectively interconnecting with adjacent wing-like extensions of adjacent burner constructions, each body section having generally one-half of said wing-like extensions thereon.

4. A jet burner construction as set forth in claim 3 wherein said wing-like extensions each has an elongated outlet slot means interconnecting with said outlet opening means and through which fuel is adapted to issue so as to burn external to said wing-like extensions.

5. In a heating apparatus comprising a heating tube means provided with an inlet and a jet burner construction comprising a burner body means having a chamber means therein and having an inlet means leading to said chamber means for directing fuel from a fuel source therein and an outlet means leading from said chamber means and defining an outlet opening means through which said fuel is adapted to issue from said chamber means to burn externally to said burner body means and enter said heating tube means through said inlet thereof, said burner body means having a longitudinal axis extending between said inlet means and said outlet means, said outlet opening means having a central opening part and a plurality of spaced apart opening portions interconnected thereto and radiating outwardly therefrom whereby flows of fuel respectively issuing out of said portions and said central part of said outlet opening means merge together in a turbulent manner externally of said outlet opening means, said burner construction comprising flame retainer means carried by said body means and having outer edge means extending beyond said outlet opening means of said body means to prevent flows of induced air from being created between the flows of fuel issuing from said radiating portions of said outlet opening means, said burner body means being formed of two generally similar body sections secured together in superimposed relation and each having generally one-half of said outlet opening means and one-half of said flame retainer means thereon, said body means having opposed ends and having a fluted portion disposed spaced from and intermediate said opposed ends of said body means and having opposed ends, said fluted portion defining said central opening part and said radiating portions of said outlet opening means, said outlet opening means being generally located in the middle of said fluted portion, said fluted portion expanding and extending axially beyond said central opening part at one of said opposed ends thereof and comprising part of said flame retainer means, said flame retainer means also comprising a generally ring-like structure between said one of said opposed ends of said fluted portion and one of said opposed ends of said body means, each one-half of said flame retainer means being integral and one-piece with its respective body section, the improvement wherein said one of said opposed ends of said fluted portion expands outwardly at a substantially sharp right angle to said longitudinal axis and with a radius of approximately 0.025 of an inch.

6. A heating apparatus as set forth in claim 5 wherein said one of said opposed ends of said fluted portion has a plurality of parts respectively separated by said radiating portions of said outlet opening means that expand substantially at said right angle from said central opening part of said outlet opening means to said ring-like structure.

7. A heating apparatus as set forth in claim 5 wherein said burner body means has wing-like extensions respectively disposed on opposite sides thereof for respectively interconnecting with adjacent wing-like extensions of adjacent burner constructions, each body section having generally one-half of said wing-like extensions thereon.

8. A heating apparatus as set forth in claim 7 wherein said wing-like extensions each has an elongated outlet slot means interconnecting with said outlet opening means and through which fuel is adapted to issue so as to burn external to said wing-like extensions.

9. In a method of making a jet burner construction comprising a burner body means having a chamber means therein and having an inlet means leading to said chamber means for directing fuel from a fuel source therein and an outlet means leading from said chamber means and defining an outlet opening means through which said fuel is adapted to issue from said chamber means to burn externally to said burner body means, said burner body means having a longitudinal axis extending between said inlet means and said outlet means, said outlet opening means having a central opening part and a plurality of spaced apart opening portions interconnected thereto and radiating outwardly therefrom whereby flows of fuel respectively issuing out of said portions and said central part of said outlet opening means merge together in a turbulent manner externally of said outlet opening means, said burner construction comprising flame retainer means carried by said body means and having outer edge means extending beyond said outlet opening means of said body means to prevent flows of induced air from being created between the flows of fuel issuing from said radiating portions of said outlet opening means, said burner body means being formed of two generally similar body sections secured together in superimposed relation and each having generally one-half of said outlet opening means and one-half of said flame retainer means thereon, said body means having opposed ends and having a fluted portion disposed spaced from and intermediate said opposed ends of said body means and having opposed ends, said fluted portion defining said central opening part and said radiating portions of said outlet opening means, said outlet opening means being generally located in the middle of said fluted portion, said fluted portion expanding and extending axially beyond said central opening part at one of said opposed ends thereof and comprising part of said flame retainer means, said flame retainer means also comprising a generally ring-like structure between said one of said opposed ends of said fluted portion and one of said opposed ends of said body means, each one-half of said flame retainer means being integral and one-piece with its respective body section, the improvement comprising the step of forming said one of said opposed ends of said fluted portion to expand outwardly at a substantially sharp right angle to said longitudinal axis and with a radius of approximately 0.025 of an inch.

10. A method of making a jet burner construction as set forth in claim 9 and comprising the step of forming said one of said opposed ends of said fluted portion to have a plurality of parts respectively separated by said radiating portions of said outlet opening means that expand substantially at said right angle from said central opening part of said outlet opening means to said ring-like structure.

11. A method of making a jet burner construction as set forth in claim 9 and comprising the step of forming said burner body means to have wing-like extensions respectively disposed on opposite sides thereof for respectively interconnecting with adjacent wing-like extensions of adjacent burner constructions, each body section having generally one-half of said wing-like extensions thereon.

12. A method of making a jet burner construction as set forth in claim 11 and comprising the step of forming said wing-like extensions to each have an elongated outlet slot means interconnecting with said outlet opening means and through which fuel is adapted to issue so as to burn external to said wing-like extensions.

13. In a method of making a heating apparatus comprising a heating tube means provided with an inlet and a jet burner construction comprising a burner body means having a chamber means therein and having an inlet means leading to said chamber means for directing fuel from a fuel source therein and an outlet means leading from said chamber means and defining an outlet opening means through which said fuel is adapted to issue from said chamber means to burn externally to said burner body means and enter said heating tube means through said inlet thereof, said burner body means having a longitudinal axis extending between said inlet means and said outlet means, said outlet opening means having a central opening part and a plurality of spaced apart opening portions interconnected thereto and radiating outwardly therefrom whereby flows of fuel respectively issuing out of said portions and said central part of said outlet opening means merge together in a turbulent manner externally of said outlet opening means, said burner construction comprising flame retainer means carried by said body means and having outer edge means extending beyond said outlet opening means of said body means to prevent flows of induced air from being created between the flows of fuel issuing from said radiating portions of said outlet opening means, said burner body means being formed of two generally similar body sections secured together in superimposed relation and each having generally one-half of said outlet opening means and one-half of said flame retainer means thereon, said body means having opposed ends and having a fluted portion disposed spaced from and intermediate said opposed ends of said body means and having opposed ends, said fluted portion defining said central opening part and said radiating portions of said outlet opening means, said outlet opening means being generally located in the middle of said fluted portion, said fluted portion expanding and extending axially beyond said central opening part at one of said opposed ends thereof and comprising part of said flame retainer means, said flame retainer means also comprising a generally ring-like structure between said one of said opposed ends of said fluted portion and one of said opposed ends of said body means, each one-half of said flame retainer means being integral and one-piece with its respective body section, the improvement comprising the step of forming said one of said opposed ends of said fluted portion to expand outwardly at a substantially sharp right angle to said longitudinal axis and with a radius of approximately 0.025 of an inch.

14. A method of making a heating apparatus as set forth in claim 13 and comprising the step of forming said one of said opposed ends of said fluted portion to have a plurality of parts respectively separated by said radiating portions of said outlet opening means that expand substantially at said right angle from said central opening part of said outlet opening means to said ring-like structure.

* * * * *